US008273936B2

(12) United States Patent
Bridges et al.

(10) Patent No.: US 8,273,936 B2
(45) Date of Patent: Sep. 25, 2012

(54) PROCESS FOR CRACKING HEAVY HYDROCARBON FEED

(75) Inventors: Robert S. Bridges, Friendswood, TX (US); Steven T. Coleman, Humble, TX (US)

(73) Assignee: Equistar Chemicals, LP, Houston, TX (US)

( * ) Notice: Subject to any disclaimer, the term of this patent is extended or adjusted under 35 U.S.C. 154(b) by 124 days.

(21) Appl. No.: 12/951,106

(22) Filed: Nov. 22, 2010

(65) Prior Publication Data

US 2012/0130139 A1 May 24, 2012

(51) Int. Cl.
*C10G 9/36* (2006.01)

(52) U.S. Cl. ..... 585/648; 585/652; 208/130; 208/132

(58) Field of Classification Search ..... None
See application file for complete search history.

(56) References Cited

U.S. PATENT DOCUMENTS

| | | | | |
|---|---|---|---|---|
| 2,023,619 | A | 12/1935 | Shefstead | |
| 3,617,493 | A | 11/1971 | Wirth et al. | |
| 7,374,664 | B2 | 5/2008 | Powers | |
| 7,404,889 | B1 | 7/2008 | Powers | |
| 7,550,642 | B2 | 6/2009 | Powers | |
| 2005/0010075 | A1 | 1/2005 | Powers | |
| 2010/0243523 | A1 * | 9/2010 | Powers | 208/92 |
| 2010/0300936 | A1 * | 12/2010 | Stell et al. | 208/130 |
| 2011/0005970 | A1 * | 1/2011 | Ou et al. | 208/44 |
| 2011/0036751 | A1 * | 2/2011 | Stein et al. | 208/40 |
| 2011/0042269 | A1 * | 2/2011 | Kuechler et al. | 208/57 |
| 2011/0233111 | A1 * | 9/2011 | Webber | 208/66 |

OTHER PUBLICATIONS

PCT International Search Report and Written Opinion, dated Jan. 25, 2012, corresponding to PCT Serial No. PCT/US/2011/06141.

* cited by examiner

*Primary Examiner* — Tam M Nguyen

(57) ABSTRACT

A process for cracking a heavy hydrocarbon feed is disclosed. The heavy hydrocarbon feed is passed to a first zone of a vaporization unit to separate a first vapor stream and a first liquid stream. The first liquid stream is passed to a second zone of the vaporization unit and contacted intimately with a countercurrent steam to produce a second vapor stream and a second liquid stream. The second vapor stream is contacted with a wash liquid in a rectification section to form a rectified stream. The first vapor stream and the rectified stream are cracked in the radiant section of the steam cracker to produce a cracked effluent.

14 Claims, 2 Drawing Sheets

PROCESS FOR CRACKING HEAVY HYDROCARBON FEED

FIELD OF THE INVENTION

This invention relates to the production of olefins and other products by steam cracking of a heavy hydrocarbon feed.

BACKGROUND OF THE INVENTION

Steam cracking of hydrocarbons is a non-catalytic petrochemical process that is widely used to produce olefins such as ethylene, propylene, butenes, butadiene, and aromatics such as benzene, toluene, and xylenes. Typically, a mixture of a hydrocarbon feed such as ethane, propane, naphtha, gas oil, or other hydrocarbon fractions and steam is cracked in a steam cracker. Steam dilutes the hydrocarbon feed and reduces coking. Steam cracker is also called pyrolysis furnace, cracking furnace, cracker, or cracking heater. A steam cracker has a convection section and a radiant section. Preheating is accomplished in the convection section, while cracking reaction occurs in the radiant section. A mixture of steam and the hydrocarbon feed is typically preheated in convection tubes (coils) to a temperature of from about 900 to about 1,000° F. (about 482 to about 538° C.) in the convection section, and then passed to radiant tubes located in the radiant section. In the radiant section, hydrocarbons and the steam are quickly heated to a hydrocarbon cracking temperature in the range of from about 1,450 to about 1,550° F. (about 788 to about 843° C.). Typically the cracking reaction occurs at a pressure in the range of from about 10 to about 30 psig. Steam cracking is accomplished without the aid of any catalyst.

After cracking in the radiant section, the effluent from the steam cracker contains gaseous hydrocarbons of great variety, e.g., from one to thirty-five carbon atoms per molecule. These gaseous hydrocarbons can be saturated, monounsaturated, and polyunsaturated, and can be aliphatic, alicyclics, or aromatic. The cracked effluent also contains significant amount of molecular hydrogen. The cracked effluent is generally further processed to produce various products such as hydrogen, ethylene, propylene, mixed $C_4$ hydrocarbons, pyrolysis gasoline, and pyrolysis fuel oil.

Conventional steam cracking systems have been effective for cracking gas feeds (e.g., ethane, propane) or high-quality liquid feeds that contain mostly light volatile hydrocarbons (e.g., gas oil, naphtha). Hydrocarbon feeds containing heavy components such as crude oil or atmospheric resid cannot be cracked using a pyrolysis furnace economically, because such feeds contain high molecular weight, non-volatile, heavy components, which tend to form coke too quickly in the convection section of the pyrolysis furnace.

Efforts have been directed to develop processes to use hydrocarbon feeds containing heavy components in steam crackers due to their availability and lower costs as compared to high-quality liquid feeds. For example, U.S. Pat. No. 3,617,493 discloses an external vaporization drum for crude oil feed and a first flash to remove naphtha as a vapor and a second flash to remove volatiles with a boiling point between 450 to 1100° F. (232 to 593° C.). The vapors are cracked in a pyrolysis furnace into olefins and the separated liquids from the two flash tanks are removed, stripped with steam, and used as fuel.

U.S. Pat. No. 7,374,664 discloses a method for utilizing whole crude oil as a feedstock for the pyrolysis furnace of an olefin production plant. The feedstock is subjected to vaporization conditions until substantially vaporized with minimal mild cracking but leaving some remaining liquid from the feedstock, the vapors thus formed being subjected to severe cracking in the radiant section of the furnace, and the remaining liquid from the feedstock being mixed with at least one quenching oil to lower the temperature of the remaining liquid.

U.S. Pat. No. 7,404,889 discloses a method for thermally cracking a hydrocarbon feed wherein the feed is first processed in an atmospheric thermal distillation step to form a light gasoline, a naphtha fraction, a middle distillate fraction, and an atmospheric residuum. The mixture of the light gasoline and the residuum is vaporized at least in part in a vaporization step, and the vaporized product of the vaporization step is thermally cracked in the presence of steam. The naphtha fraction and middle distillate fraction are not cracked. Middle distillates typically include heating oil, jet fuel, diesel fuel, and kerosene.

U.S. Pat. No. 7,550,642 discloses a method for processing a liquid crude and/or natural gas condensate feed comprising subjecting the feed to a vaporization step to form a vaporous product and a liquid product, subjecting the vaporous product to thermal cracking, and subjecting the liquid product to crude oil refinery processing.

The vapor stream separated by the vaporization step taught by U.S. Pat. Nos. 7,404,889 and 7,550,642 may contain non-volatile components, which can form coke in the convection tubes and/or radiant tubes. This invention is aimed to solve such a problem.

SUMMARY OF THE INVENTION

This invention is a process for cracking a heavy hydrocarbon feed. The heavy hydrocarbon feed is passed to a first zone of a vaporization unit to separate a first vapor stream and a first liquid stream. The first liquid stream is passed to a second zone of the vaporization unit and intimately contacted with a countercurrent steam to produce a second vapor stream and a second liquid stream. The second vapor stream is contacted with a wash liquid in a rectification section to form a rectified stream. The first vapor stream and the rectified stream are cracked in the radiant section of the steam cracker to produce a cracked effluent.

DETAILED DESCRIPTION OF THE INVENTION

Figure 1:
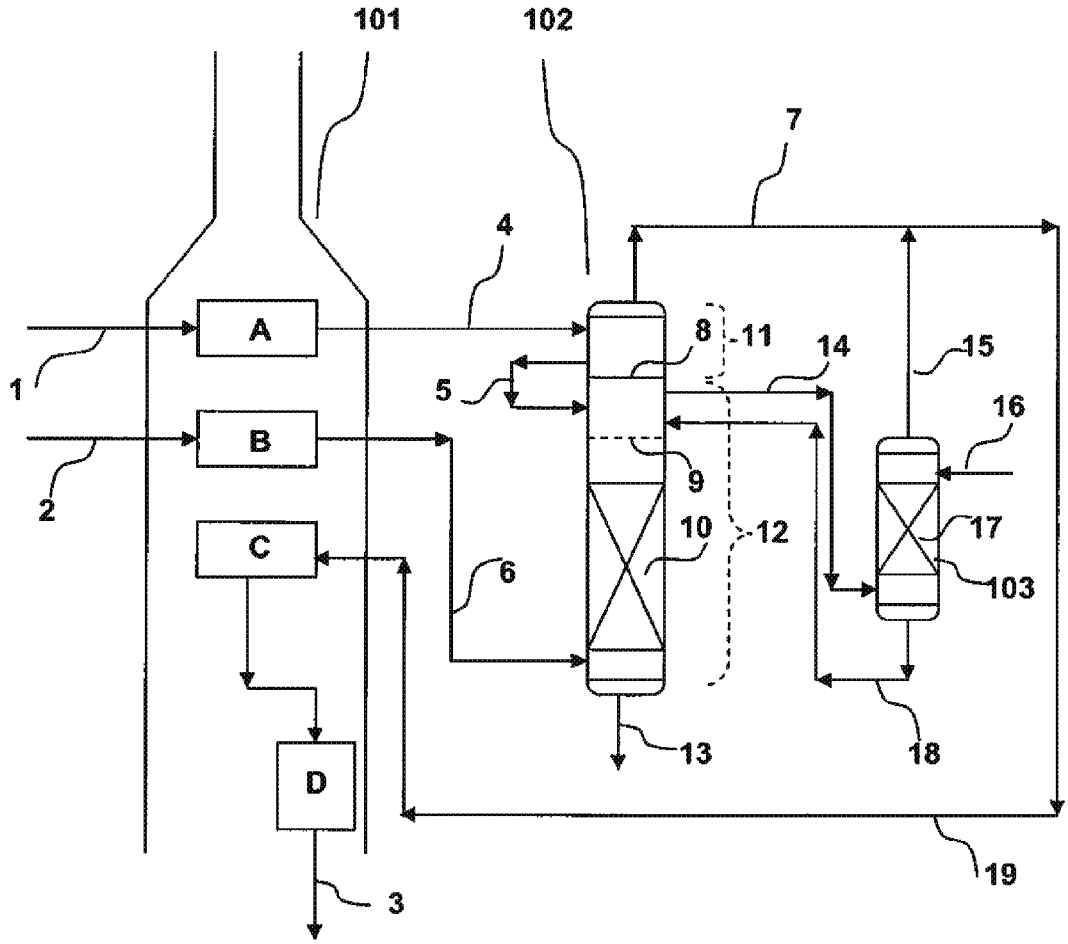
FIG. 1 is a scheme illustrating one embodiment of the invention.

The invention is a process for steam cracking a heavy hydrocarbon feed to produce ethylene, propylene, $C_4$ olefins, pyrolysis gasoline, and other products.

The heavy hydrocarbon feed may comprise one or more of gas oils, heating oils, jet fuels, diesels, kerosenes, gasolines, synthetic naphthas, raffinate reformates, Fischer-Tropsch liquids, Fischer-Tropsch gases, natural gasolines, distillates, virgin naphthas, crude oils, natural gas condensates, atmospheric pipestill bottoms, vacuum pipestill streams including bottoms, wide boiling range naphtha to gas oil condensates, heavy non-virgin hydrocarbon streams from refineries, vacuum gas oils, heavy gas oils, atmospheric residuum, hydrocracker wax, Fischer-Tropsch wax, and the like. One preferred heavy hydrocarbon feed is a crude oil.

The terms "hydrocarbon" or "hydrocarbonaceous" refers to materials that are primarily composed of hydrogen and carbon atoms but can contain other elements such as oxygen, sulfur, nitrogen, metals, inorganic salts, and the like.

The term "whole crude oil," "crude oil," "crude petroleum," or "crude" refers to a liquid oil suitable for distillation but which has not undergone any distillation or fractionation. Crude oil generally contains significant amount of hydrocarbons and other components that boil at or above 1,050° F. (565° C.) and non-boiling components such as asphaltenes or tar. As such, it is difficult, if not impossible, to provide a boiling range for whole crude oil.

The term "naphtha" refers to a flammable hydrocarbon mixture having a boiling range between about 30 and about 232° C., which is obtained from a petroleum or coal tar distillation. Naphtha is generally a mixture of hydrocarbon molecules having between 5 and 12 carbon atoms.

The term "light naphtha" refers to a hydrocarbon fraction having a boiling range of between 30 and 90° C. It generally contains hydrocarbon molecules having between 5 to 6 carbon atoms.

The term "heavy naphtha" refers to a hydrocarbon fraction having a boiling range of between 90 and 232° C. It generally contains hydrocarbon molecules having between 6 to 12 carbons.

The term "Fischer-Tropsch process" or "Fischer-Tropsch synthesis" refers to a catalytic process for converting a mixture of carbon monoxide and hydrogen into hydrocarbons.

The term "atmospheric resid" or "atmospheric residue" refers to a distillation bottom obtained in an atmospheric distillation of a crude oil in a refinery. The atmospheric resid obtained from an atmospheric distillation is sometimes referred to as "long resid" or "long residue." To recover more distillate product, further distillation is carried out at a reduced pressure and high temperature, referred to as "vacuum distillation." The residue from a vacuum distillation is referred to as a "short resid" or "short residue."

Steam crackers typically have rectangular fireboxes with upright radiant tubes located between radiant refractory walls. Steam cracking of hydrocarbons is accomplished in the radiant tubes. The tubes are supported from their top. Firing of the radiant section is accomplished with wall or floor mounted burners or a combination of both using gaseous or combined gaseous/liquid fuels. Fireboxes are typically under slight negative pressure, most often with upward flow of flue gas. The flue gas flows into the convection section by natural draft and/or induced draft fans, where it is cooled, typically by heating the cracking heater feed and generating or superheating steam, before exiting the heater via the stack. Radiant tubes are usually hung in a single plane down the center of the fire box. They can be nested in a single plane or placed parallel in a staggered, double-row tube arrangement. Heat transfer from the burners to the radiant tubes occurs largely by radiation, hence the term "radiant section," where the hydrocarbons are heated to a temperature of about 1,400 to about 1,550° F. (about 760 to 843° C.). Several engineering contractors including ABB Lummus Global, Stone and Webster, Kellogg-Braun & Root, Linde, and KTI offer cracking furnace technologies.

The cracked effluent leaving the radiant section is rapidly cooled to prevent destruction of the cracking pattern. A large amount of heat is recovered in the form of high pressure steam, which can be used in the olefin plant or elsewhere. The heat recovery is often accomplished by the use of transfer line exchangers (TLE) that are known in the art. The cooled effluent is separated into desired products, in a recovery section of the olefin plant, by fractionation in conjunction with compression, condensation, adsorption and hydrogenation. These products include hydrogen, methane, ethylene, propylene, crude $C_4$ hydrocarbons, pyrolysis gasoline, and pyrolysis fuel oil. The term "pyrolysis gasoline" refers to a fraction having a boiling range of from about 100 to about 400° F. (38 to 204° C.). The term "pyrolysis fuel oil" refers to a fraction having a boiling range of from about 400° F. (204° C.) to the end point, e.g., greater than 1200° F. (649° C.).

Coke is produced as a byproduct that deposits on the radiant tube interior walls, and less often in the convection tube interior walls when a gas feed or a high-quality liquid feed that contain mostly light volatile hydrocarbons is used. The coke deposited on the reactor tube walls limits the heat transfer to the tubes, increases the pressure drop across the coil, and affects the selectivity of the cracking reaction. The term "coke" refers to any high molecular weight carbonaceous solid, and includes compounds formed from the condensation of polynuclear aromatics. Periodically, the cracker has to be shut down and cleaned, which is called decoking. Typical run lengths are 40 to 100 days between decokings. Coke also deposits in transfer line exchangers.

Conventional steam crackers are effective for cracking high-quality liquid feeds, such as gas oil and naphtha. Heavy hydrocarbon feeds contain high molecular weight components with boiling points in excess of about 1000° F. (538° C.). These high boiling point or "non-volatile" components in the feed tend to lay down as coke in the convection section and the radiant tubes of conventional pyrolysis furnaces. Only very low levels of these non-volatile components can be tolerated in to the convection section. Therefore, a heavy feed containing greater than 0.5 wt % of these non-volatile components would typically be excluded from consideration as a feedstock to a conventional steam cracker. The heavy hydrocarbon feed accommodated by this invention generally contains greater than 1 wt % of these non-volatile components, preferably greater than 5 wt %, more preferably greater than 10 wt %.

The process of this invention comprises directing the heavy hydrocarbon feed, preferably after preheating in the heater convection section, to a first zone of a two zone vaporization unit. In this zone, the vapor generated in the convection section is separated from the liquid, producing the first vapor stream and the first liquid stream. The temperature in this first zone is typically 350 to 750° F. (177 to 399° C.) at about 15 to 100 psig. The first vapor stream exits the first zone and enters the radiant section of the steam cracker.

The first liquid stream enters the second zone of the vaporization unit. Generally the second zone is located below the first zone. In the second zone, the first liquid is contacted with steam in a countercurrent fashion so that at least a portion of hydrocarbon components are vaporized. The steam, preferably at a temperature of from about 900 to about 1300° F. (482 to 704° C.), enters the second zone and provides additional thermal energy to the liquid hydrocarbons and reduces the hydrocarbon partial pressure in the second zone which promotes further vaporization of the liquid hydrocarbons. The remaining liquid hydrocarbons (the second liquid stream) exit the second zone from the bottom of the vaporization unit. Typically, the second zone is operated at a temperature of from about 500 to about 900° F. (260 to 482° C.) and a pressure of from about 15 to about 100 psig. The weight ratio of steam fed to the second zone to the first liquid stream entering the second zone may be in the range of about 0.3:1 to about 1:1.

The second zone of the vaporization unit contains internals which promote vapor/liquid contacting, allowing the more volatile components of the liquid to transfer to the vapor phase. These internals could be fractionation trays, such as bubble cap trays, valve trays, and sieve trays, or packing, either structured or random.

According to this invention, the vaporous hydrocarbon stream formed in the second zone (the second vapor stream) is contacted with a wash liquid in a rectification section to produce a rectified vapor stream. The second vapor stream tends to contain small amounts of non-volatile components due to the carry over of the non-volatile components in the form of tiny droplets, a phenomena called entrainment.

The rectification section may be located within or outside of the vaporization unit. It may have many suitable tray designs or packings, like the one used in the second zone of the vaporization unit. Generally, the second vapor stream enters the rectification section near its bottom and the wash liquid enter the rectification section from the top of the rectification section, so that the second vapor stream contacts the wash liquid in a countercurrent flow fashion. As a result, the wash liquid removes at least part of the non-volatile components from the second vapor stream.

The wash liquid is generally a hydrocarbon, water, or a mixture of both that is a liquid at ambient temperature and pressure. Typically, the wash liquid contains hydrocarbons having from about 5 to about 20 carbon atoms per molecule. Suitable hydrocarbons that are suitable as wash liquids include naphtha, kerosene, diesel, gas oil, and their mixtures. Naphtha is one preferred wash liquid.

The wash liquid preferably enters the top portion of the rectification section at a temperature from ambient temperature to about 300° F. (150° C.). A portion of the wash liquid may be vaporized in the rectification section and/or in the second zone. The hydrocarbon vapors thus formed become part of the second vapor stream. The remaining wash liquid returns to the second zone of the vaporization unit.

Some hydrocarbon streams obtained from the process may be used as a wash liquid. For example, a portion of the first vapor stream from the first zone of the vaporization unit may be condensed and used as a wash liquid. Alternatively, injection of water into a portion of the rectified vapor stream may result in a hydrocarbon-water mixture, which is suitably used as a wash liquid. The amount of wash liquid introduced into the rectification section can vary widely depending on the composition of the heavy hydrocarbon feed and operating conditions. Generally, the weight ratio of the wash liquid to the heavy hydrocarbon feed is about 0.05:1 to 0.2:1.

FIG. 1 is a process flow diagram of a part of an olefin plant according to this invention. A crude oil feed 1 is passed through a preheat zone A of the convection section of furnace 101 and fed via line 4 to vaporization unit 102, which includes an upper zone (the first zone) 11 and a lower zone (the second zone) 12. Hydrocarbon vapors that are associated with the preheated feed as received by unit 102, and additional vapors formed in zone 11, are removed from zone 11 by way of line 7 as the first vapor stream.

The hydrocarbon liquid (the first liquid stream) that is not vaporized in zone 11 moves downwardly via line 5 to the upper interior of zone 12. Zones 11 and 12 are separated from fluid communication with one another by an impermeable wall 8, which, for example, can be a solid tray. Line 5 represents external fluid down-flow communication between zones 11 and 12. If desired, zones 11 and 12 may have internal fluid communication between them by modifying wall 8 to be at least in part liquid-permeable to allow for the liquid in zone 11 to pass down into the upper interior of zone 12 and the vapor in zone 12 to pass up into the lower interior of zone 11.

The first liquid stream preferably encounters at least one liquid distribution device 9 in the second zone. Device 9 evenly distributes liquid across the transverse cross section of unit 102 so that the downwardly flowing liquid spreads uniformly across the width of the tower before it contacts a stripping bed 10. Suitable liquid distribution devices include perforated plates, trough distributors, dual flow trays, chimney trays, spray nozzles, and the like.

Bed 10 extends across the full transverse cross section of unit 102 with no large open vertical paths or conduits through which a liquid can flow unimpeded by bed 10. Thus, the downwardly flowing liquid cannot flow from the top to the bottom of the second zone 12 without having to pass through bed 10. Preferably, bed 10 contains packing materials and/or trays for promoting intimate mixing of liquid and vapor in the second zone.

Primary dilution steam, generated by preheating a low temperature steam in line 2 by zone B, is introduced into the lower portion of zone 12 below bed 10 via line 6. The first liquid stream mixes with the steam in bed 10. As a result, additional vapor hydrocarbons (the second vapor stream) are formed in zone 12.

The newly formed vapor, along with the dilution steam, is removed from zone 12 via line 14 and is passed to the bottom of a rectification column 103 below rectification bed 17. A wash liquid is fed to the top of the rectification column 103 above rectification bed 17. The wash liquid is mixed with the uprising hydrocarbon vapor and steam in bed 17 so that at least a portion of non-volatile components in the vapor is washed down by the wash liquid and returned to the vaporization unit via line 18. The rectified vapor stream exiting from the top of column 17 is combined with the vapor in line 7 and passed through a preheat zone C in the convection zone of furnace 101, further heated to a higher temperature, and enters the radiant tubes in the radiant section D of furnace 101. In the radiant section D, the vaporous hydrocarbons are cracked. The remaining liquid hydrocarbons (the second liquid stream) in zone 12 exits vaporization unit 102 from the bottom, which may be sold or processed elsewhere.

Figure 2:
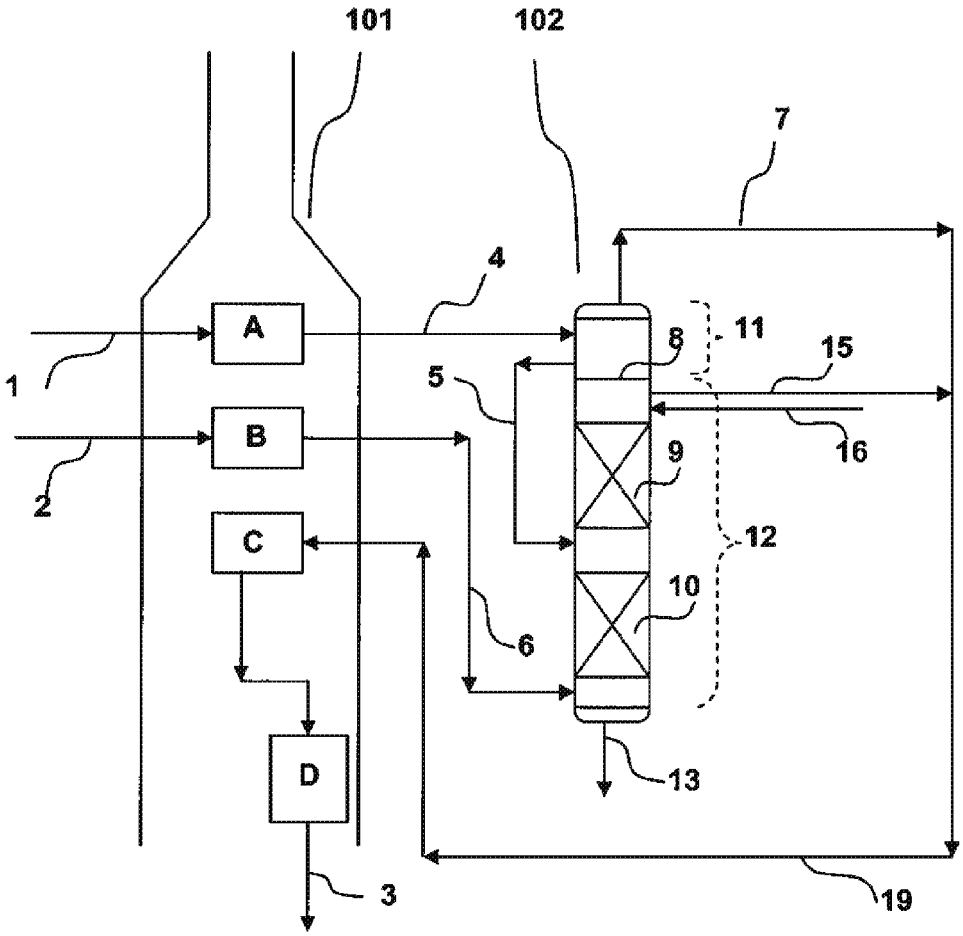
FIG. 2 is a scheme illustrating another embodiment of the invention.

FIG. 2 shows another embodiment of this invention. The process flow diagram in FIG. 2 is similar to that of FIG. 1 except that a rectification bed 9 is within the second zone of the vaporization unit and the first zone 11 and the second zone 12 are separated by an impermissible wall 8. The first liquid stream in line 5 enters the second zone of the vaporization unit between the stripping bed 10 and rectification bed 9. A wash liquid enters the vaporization unit via line 16, which is directed above bed 9. The first liquid stream is contacted with uprising steam in bed 10 to form a mixture of hydrocarbon vapor and steam, which is further contacted with a wash liquid in bed 9 so that at least a portion of non-volatile components is washed down by the wash liquid with in bed 9.

EXAMPLE

FIG. 2 illustrates a steam cracking process in an olefin plant according to this invention. A crude oil known as Saharan blend is fed via line 1 to preheat zone A of the convection section of pyrolysis furnace 101 at a rate of 75,000 lb/h at ambient temperature and pressure. The crude contains about 9 wt % of hydrocarbons that boil at a temperature higher than 1,050° F. (565° C.). In the convection section, the feed is heated to about 650° F. (343° C.) at about 60 psig, and then passed via line 4 into the upper zone 11 of vaporization unit 102. The vaporized portion of the crude oil is separated from the remaining liquid. The vapors are removed from zone 11 via line 7.

The hydrocarbon liquid remaining in zone 11 travels to lower zone 12 via line 5 and enters zone 12 at a point between stripping bed 10 and rectification bed 9. The internals in both the rectification and stripping sections of zone 12 are structured packing. The hydrocarbon liquid entering zone 12 is intimately contacted with the uprising steam that is introduced to the vaporization unit via line 6 and at a temperature of 1200° F. (650° C.). The flow rate of the high temperature steam in line 6 is 27,000 lb/h. A mixture of hydrocarbon vapors and steam is formed between sections 9 and 10. The mixture is further contacted with naphtha wash liquid in section 9. The wash liquid enters the vaporization unit via line 16 at a temperature of 80° F. (27° C.) and at a rate of 2000 lb/h. The vapor stream formed in the second zone of the vaporization unit at the top of section 9 exits the vaporization unit and combined with the first vapor stream in line 7, preheated in zone C, and introduced into zone D of the radiant section at an expected total flow rate of 97,000 lb/h for thermal cracking at a temperature in the range of 1,450 F to 1,550° F. (788 to 843° C.). The cracked products and steam are removed by way of line 3 for down-stream processing in the recovery section (not shown in FIG. 1) of the olefin plant. The residual oil from zone 12 is removed from unit 102 at an expected rate of 7,000 lb/h at a temperature of about 600° F. (315° C.) via line 13.

The amount of non-volatile components in the vapor stream that is passed to the radiant section (zone D) for cracking is reduced because of the use of the wash liquid and a rectification bed in the process.

We claim:

1. A process for cracking a heavy hydrocarbon feed in a steam cracker having a convection section and a radiant section, the process comprising:

(a) passing the heavy hydrocarbon feed to a first zone of a vaporization unit and separating the feed into a first vapor stream and a first liquid stream in the first zone;

(b) passing the first liquid stream to a second zone of the vaporization unit and contacting the first liquid stream with countercurrent steam in the second zone of the vaporization unit to mix the first liquid stream with the steam to produce a second vapor stream and a second liquid stream;

(c) contacting the second vapor stream with a wash liquid in a rectification section to produce a rectified vapor stream; and (d) steam-cracking the first vapor stream and the rectified vapor stream in the radiant section of the steam cracker to produce a cracked effluent.

2. The process of claim 1 wherein the heavy hydrocarbon feed comprises at least 1 wt % hydrocarbons with boiling points higher than 565° C.

3. The process of claim 1 wherein the heavy hydrocarbon feed comprises at least 10 wt % hydrocarbons with boiling points higher than 565° C.

4. The process of claim 1 wherein the heavy hydrocarbon feed is heated to 177 to 399° C. in the convection section of the steam cracker before it enters the first zone of the vaporization unit.

5. The process of claim 1 wherein the first zone of the vaporization unit is at a temperature of from 177 to 399° C. and a pressure of 15 to 100 psig.

6. The process of claim 1 wherein the countercurrent steam is at a temperature of from 538 to 704° C. and a pressure of 15 to 100 psig.

7. The process of claim 1 wherein the second zone of the vaporization unit is at a temperature of from 260 to 482° C. and a pressure of 15 to 100 psig.

8. The process of claim 1 wherein the rectification section is outside the vaporization unit.

9. The process of claim 1 wherein the rectification section is within the second zone of the vaporization unit and is above the point at which the first liquid stream enters the second zone.

10. The process of claim 1 wherein the wash liquid comprises $C_5$ to $C_{40}$ hydrocarbons.

11. The process of claim 1 wherein the wash liquid is a liquid selected from the group consisting of naphtha, kerosene, diesel, gas oil, and mixtures thereof.

12. The process of claim 1 wherein the wash liquid is a naphtha.

13. The process of claim 1 wherein the wash liquid is produced by condensing a portion of the first vapor stream.

14. The process of claim 1 wherein the wash liquid is produced by injecting water into a portion of the rectified stream.

* * * * *